US006274975B1

(12) United States Patent
Reed et al.

(10) Patent No.: US 6,274,975 B1
(45) Date of Patent: Aug. 14, 2001

(54) COLOR PICTURE TUBE HAVING A TENSION MASK ATTACHED TO A FRAME

(75) Inventors: Joseph Arthur Reed, York; Anthony Socrates Poulos, Leola; Frank Rowland Ragland, Jr., Lancaster, all of PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/283,497

(22) Filed: Apr. 1, 1999

(51) Int. Cl.[7] ..... H01J 29/80
(52) U.S. Cl. ..... 313/407; 313/402
(58) Field of Search ..... 313/402, 407, 313/403, 408

(56) References Cited

U.S. PATENT DOCUMENTS

| | | | | |
|---|---|---|---|---|
| 3,573,528 | | 4/1971 | Maeda | 313/85 |
| 3,731,134 | * | 5/1973 | Iida | 313/402 |
| 3,808,493 | * | 4/1974 | Kawamura et al. | 313/407 |
| 4,333,034 | | 6/1982 | Ohgoshi et al. | 313/407 |
| 5,085,606 | | 2/1992 | Kaplan et al. | 445/30 |
| 5,594,300 | | 1/1997 | Nosker et al. | 313/402 |

FOREIGN PATENT DOCUMENTS

| | | | |
|---|---|---|---|
| 19 828 139A1 | 1/1999 | (DE) | H01J/29/07 |
| 0286187A2 | 10/1988 | (EP) | H01J/29/07 |
| 0489920A1 | 6/1992 | (EP) | H01J/9/14 |
| 060260A1 | 6/1994 | (EP) | H01J/29/07 |
| 0911857A2 | 4/1999 | (EP) | H01J/29/07 |
| 2121826 | 8/1972 | (FR) | H01J/29/00 |
| 2308223 | 6/1997 | (GB) | H01J/9/14 |
| 2311165 | 9/1997 | (GB) | H01J/9/14 |

OTHER PUBLICATIONS

PCT Search Report dated Jun. 16, 2000.

* cited by examiner

*Primary Examiner*—Nimeshkumar D. Patel
*Assistant Examiner*—Joseph Williams
(74) *Attorney, Agent, or Firm*—Joseph S. Tripoli; Dennis H. Irlbeck

(57) ABSTRACT

The present invention provides an improvement in a color picture tube having a tension mask supported by a support frame mounted within the tube. The mask includes an active apertured portion formed by a plurality of parallel vertically extending strands, between which are elongated operational apertures through which electron beams pass during operation of the tube. Top and bottom border portions, outside the active apertured portion of the mask, have additional apertures therein that are aligned with the longitudinal centerlines of the strands.

5 Claims, 4 Drawing Sheets

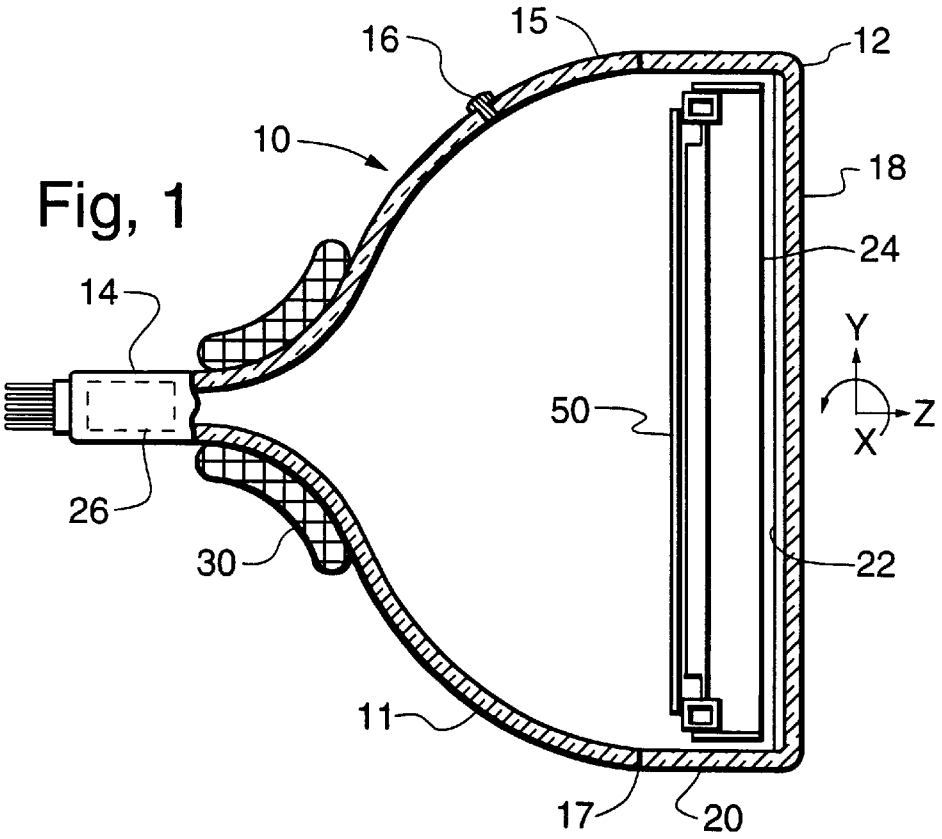
Fig, 1
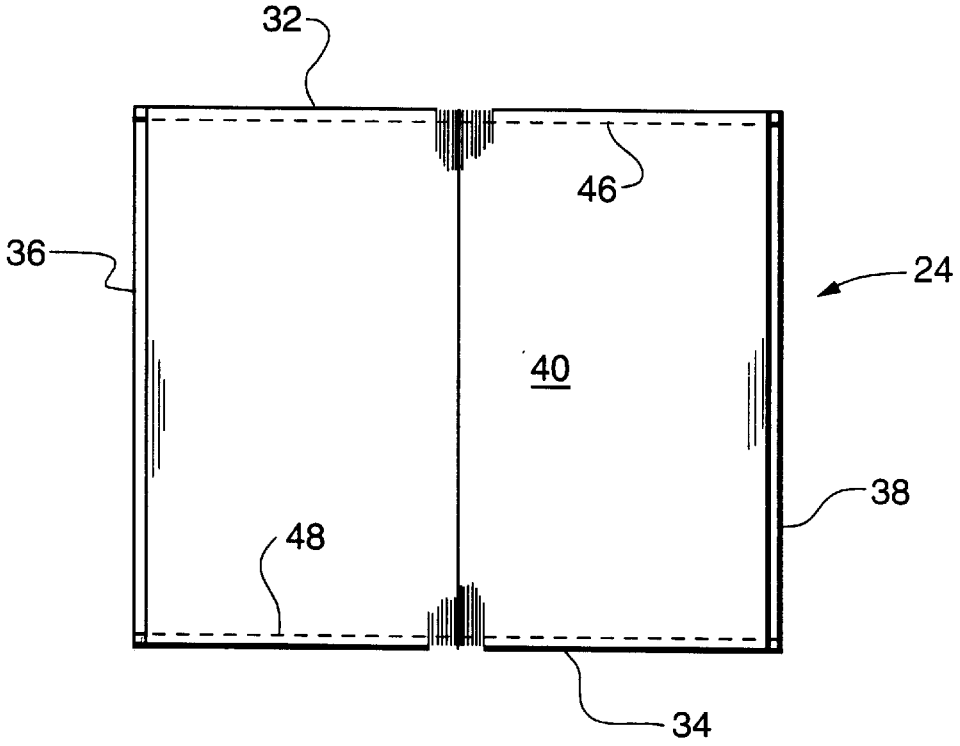
Fig. 2

COLOR PICTURE TUBE HAVING A TENSION MASK ATTACHED TO A FRAME

This invention relates to color picture tubes having tension masks, and particularly to a tube having means for connecting a tension mask to a support frame, such that the stresses on the mask caused by thermal expansion of the frame are minimized or reduced.

BACKGROUND OF THE INVENTION

A color picture tube includes an electron gun for generating and directing three electron beams to the screen of the tube. The screen is located on the inner surface of a faceplate of the tube and is made up of an array of elements of three different color emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tension mask mounted within a faceplate panel thereof. In order to maintain the tension on the mask, the mask must be attached to a relatively massive support frame. Although such tubes have found wide consumer acceptance, there is still a need for further improvement, to reduce the weight and cost of the mask-frame assemblies in such tubes.

It has been suggested that a lighter frame could be used in a tension mask tube if the required tension on a mask is reduced. One way to reduce the required mask tension is to make the mask from a material having a low coefficient of thermal expansion. However, a mask from such material would require a support frame of a material having a similar coefficient of thermal expansion, to prevent any mismatch of expansions during thermal processing that is required for tube manufacturing, and during tube operation. Because the metal materials that have low coefficients of thermal expansion are relatively expensive, it is relatively costly to make both the mask and frame out of identical or similar materials. Therefore, it is desirable to use the combination of a low expansion tension mask with a higher expansion support frame, and to provide a solution to the problem that exists when there is a substantial mismatch in coefficients of thermal expansion between a tension mask and its support frame.

The present invention provides an improvement in a color picture tube having a tension mask supported by a support frame mounted within the tube. The mask includes an active apertured portion formed by a plurality of parallel vertically extending strands, between which are elongated operational apertures through which electron beams pass during operation of the tube. Top and bottom border portions, outside the active apertured portion of the mask, have additional elongated apertures therein that are aligned with the longitudinal centerlines of strands.

BRIEF DESCRIPTION OF THE DRAWINGS

In the drawings:

FIG. 1 is a side view, partly in axial section, of a color picture tube embodying the invention.

FIG. 2 is a front view of a tension shadow mask.

DETAILED DESCRIPTION OF THE PREFERRED EMBODIMENTS

Figure 5:
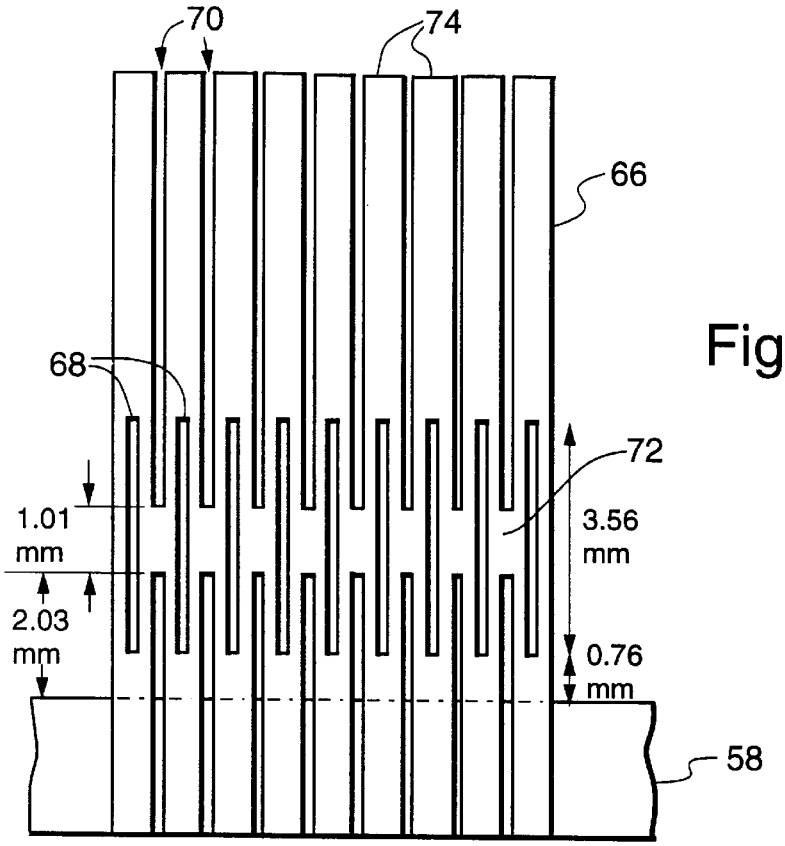
Figure 6:
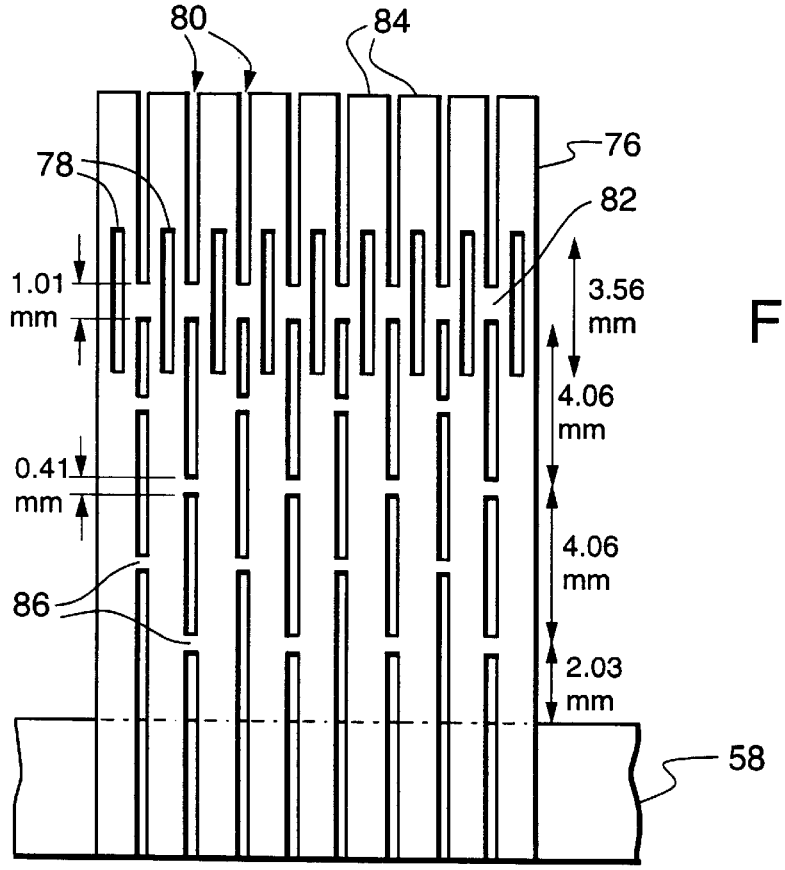

FIGS. 5 and 6 are front views of small sections of two different alternative embodiments of tension mask border portions.

Figure 7:
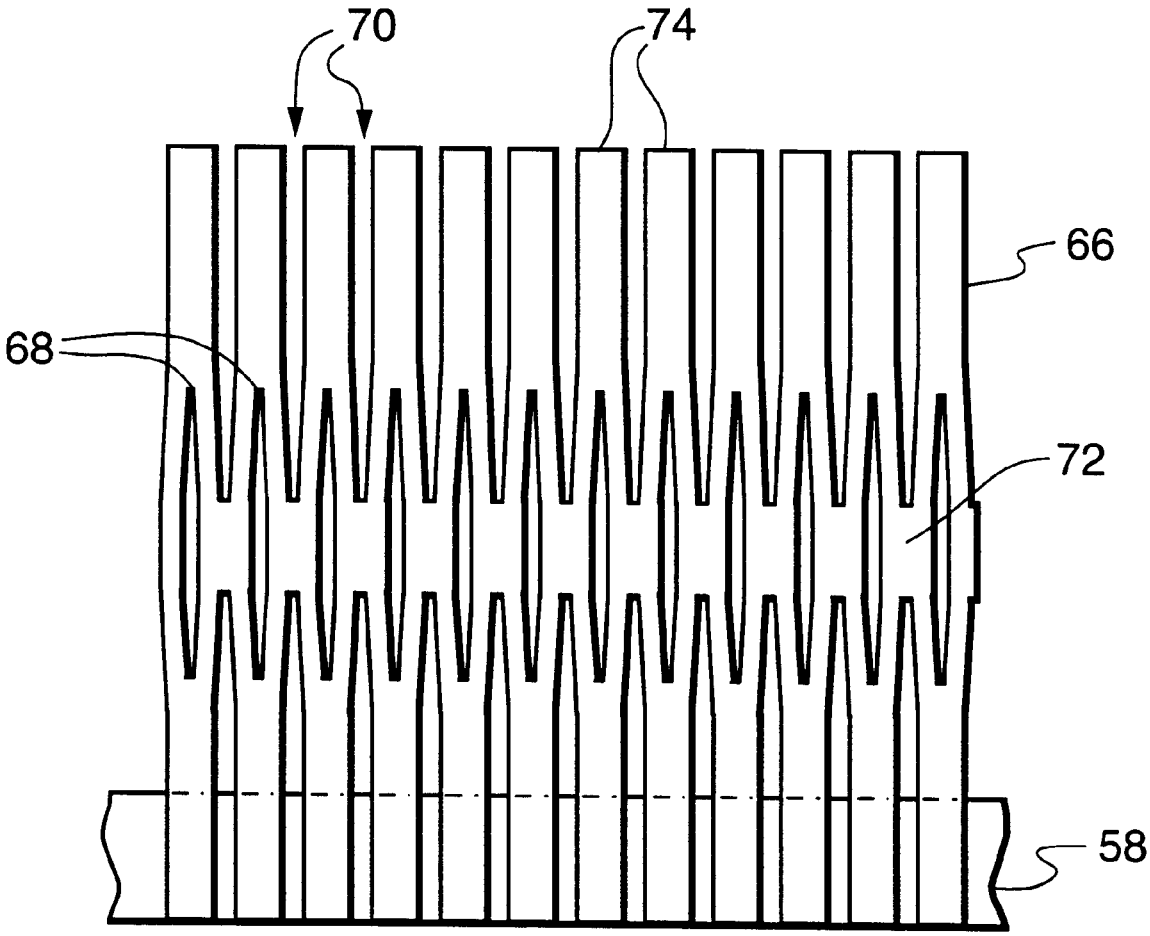

FIG. 7 is a front view of a small section of the tension mask of FIG. 5, illustrating a bellows action of the mask during frame expansion.

FIG. 1 shows a color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the wide portion of the funnel and to the neck 14. The panel 12 comprises a substantially flat external viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A color selection tension mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 3:
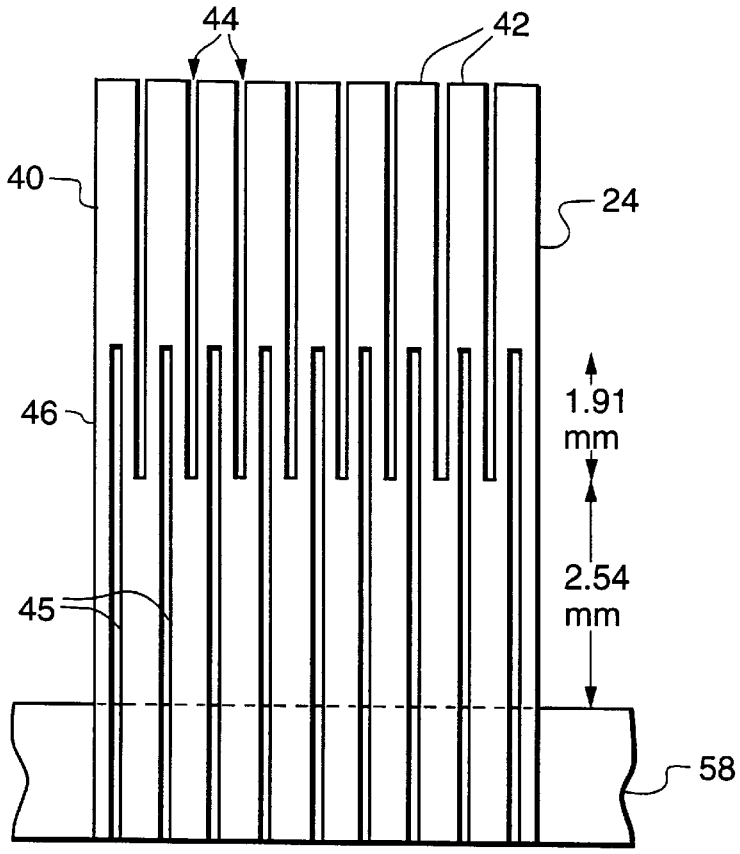
FIG. 3 is a front view of a small section of a border portion of the mask of FIG. 2.

The tension mask 24, shown in FIGS. 2 and 3, includes two long sides 32 and 34, and two short sides 36 and 38. The two long sides 32 and 34 of the mask parallel a central major axis, X, of the mask; and the two short sides 36 and 38 parallel a central minor axis, Y, of the mask. The tension mask 24 includes an active apertured portion 40 that contains a plurality of parallel vertically extending strands 42. The strands 42 in the active apertured portion may or may not include connecting tie bars (not shown). A multiplicity of elongated operational apertures 44, between the strands 42, parallel the minor axis Y of the mask. The electron beams pass through the operational apertures 44 in the active portion 40 during tube operation. Each operational aperture 44 extends into two border portions 46 and 48 at the long sides 32 and 34, respectively, of the mask. The strands 42 are split by the inclusion of elongated additional apertures 45 that are aligned with the longitudinal centers of the strands. The additional apertures 45 overlap the operational apertures 44 in a spaced interdigitated fashion. The purpose of the additional apertures 45 in the border portions 46 and 48 of the mask 24 is to accommodate a greater expansion of the frame 50 compared to that of the mask 24, without causing appreciable relocation of the mask strands 42 in the active portion 40 of the mask.

Figure 4:
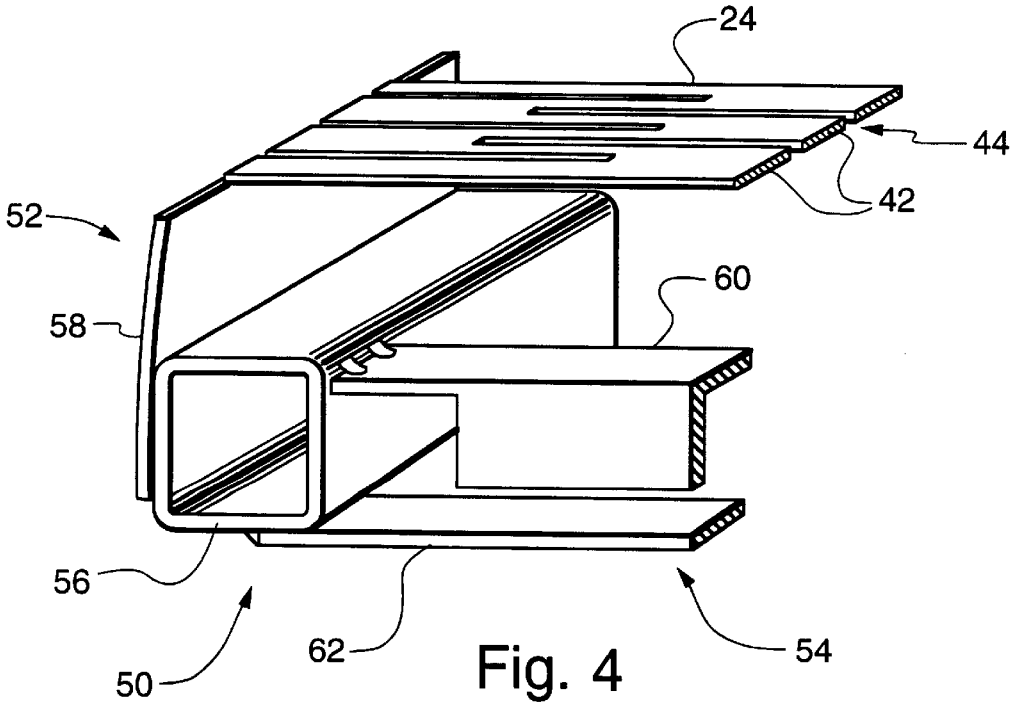
FIG. 4 is a perspective view of a corner of a tension shadow mask-frame assembly.

A frame 50, for use with the tension shadow mask 24 is partially shown in FIG. 4. The frame 50 includes four sides: two long sides 52, substantially paralleling the major axis X of the tube, and two short sides 54, paralleling the minor axis Y of the tube. Each of the two long sides 52 includes a rigid section 56 and a compliant section 58 cantilevered from the rigid section. The rigid sections 56 are hollow tubes, and the compliant sections 58 are metal plates. Each of the short sides 54 has an L-shaped cross-section upper portion 60 parallel to and separated from a flat bar-shaped lower portion 62. The two long sides 32 and 34 of the tension mask 24 are welded to the distal ends of the compliant sections 58. Although the present invention is described by way of embodiments using the frame 50, it is to be understood that many other types of tension frames could also be used for the present invention.

Other embodiments of mask borders having different patterns of additional apertures are shown in FIGS. 5 and 6. In a mask 66, shown in FIG. 5, additional apertures 68 are located between operational apertures 70, adjacent to large tie bars 72 in the operational apertures that connect strands 74 of the mask. The additional apertures 68 are centered on the longitudinal centerlines of the strands 74, and overlap portions of the operational apertures 70 above and below the tie bars 72. In another mask 76, shown in FIG. 6, additional apertures 78 are located between operational apertures 80, adjacent to large tie bars 82 in the operational apertures that connect strands 84 of the mask. The remaining portions of the operational apertures 80, near the mask border edges, include smaller tie bars 86. The additional apertures 78 are centered on the longitudinal centerlines of the strands 84, and overlap portions of the operational apertures 80 above and below the large tie bars 82.

The dimensions given in FIGS. 3, 5 and 6 are representative values for a tension mask approximately 49.5 cm by 41.3 cm. The mask material is Invar, about 0.10 mm (4 mils) thick, and the frame material is steel.

All known commercially used tension shadow mask tubes have had solid border portions at the mask-to-frame weld points. This was acceptable when the mask and frame were made from similar expanding materials. However, when a mask and frame differ greatly in coefficients of thermal expansion, such solid border portions will deform, thereby permanently deforming the active portion of the mask during thermal processing of the tube. The additional apertures of the present invention aid in preventing substantial distortion in the active portion of the mask by providing a "mechanical filter" that accommodates any individual strand attachment errors or movements during processing or tube operation. FIG. 7 illustrates the effect that expansion of the frame compliant section 58 has on the mask 66 of FIG. 5. Expansion of the compliant section 58 results in a bellows action on the additional apertures 68 in the mask, whereby the mask expands in the direction of the thermal expansion of the compliant sections 58.

What is claimed is:

1. In a color picture tube having a tension mask attached to a support frame mounted within said tube, the improvement comprising said mask having an active apertured portion formed by a plurality of parallel vertically extending strands, between which are elongated operational apertures through which electron beams pass during operation of said tube, and top and bottom border portions, outside said active apertured portion, having elongated additional apertures therein that are aligned with the longitudinal centerlines of said strands.

2. The color picture tube as defined in claim 1, wherein the operational apertures extend into the border portions, and said additional apertures overlap portions of said operational apertures in a spaced interdigitated fashion.

3. The color picture tube as defined in claim 2, wherein said mask has a significantly higher coefficient of thermal expansion than that of said frame.

4. The color picture tube as defined in claim 3, wherein said mask is made from Invar and said frame is made from steel.

5. The color picture tube as defined in claim 1, wherein said strands have tie bars therebetween in the active apertured portion of said mask.

* * * * *